US005899283A

United States Patent [19]

Cox

[11] Patent Number: 5,899,283

[45] Date of Patent: May 4, 1999

[54] DRILL BIT FOR HORIZONTAL DIRECTIONAL DRILLING OF ROCK FORMATIONS

[75] Inventor: David M. Cox, Crowley, Tex.

[73] Assignee: Railhead Underground Products, L.L.C., Ft. Worth, Tex.

[21] Appl. No.: 08/968,254

[22] Filed: Nov. 12, 1997

Related U.S. Application Data

[XX .

[60] Provisional application No. 60/040,747, Feb. 5, 1997.

[51] Int. Cl.[6] ..... E21B 10/00

[52] U.S. Cl. ..... 175/376; 175/398

[58] Field of Search ..... 175/376, 398–400

[56] References Cited

U.S. PATENT DOCUMENTS

| | | | |
|---|---|---|---|
| 2,704,204 | 3/1955 | Koontz . | |
| 4,867,255 | 9/1989 | Baker et al. . | |
| 4,989,681 | 2/1991 | Lohmüller . | |
| 5,052,503 | 10/1991 | Löf . | |
| 5,148,875 | 9/1992 | Karlsson et al. . | |
| 5,148,880 | 9/1992 | Lee et al. | 175/398 X |
| 5,163,520 | 11/1992 | Gibson et al. . | |
| 5,253,721 | 10/1993 | Lee . | |
| 5,392,868 | 2/1995 | Deken et al. | 175/376 X |
| 5,449,046 | 9/1995 | Kinnan | 175/73 X |
| 5,469,926 | 11/1995 | Lessard . | |
| 5,484,029 | 1/1996 | Eddison . | |

OTHER PUBLICATIONS

"Brochure for Barbco Directional Tooling", Barbco, Inc., Undated.

"Brochure for Straightline Directional Tooling—Training Seminar", Straightline Directional Drilling Systems, Jun. 14, 1996.

*Primary Examiner*—Roger Schoeppel

*Attorney, Agent, or Firm*—Daniel V. Thompson

[57] ABSTRACT

A drill bit for directional boring of all earth formations such as dirt, sand, rock and/or any type combination of formations, utilizing a bit body containing fixed and semi-floating cutting points and one or more fluid channels for the purpose of lubricating and dispersing cut and/or fractured formations.

7 Claims, 2 Drawing Sheets

DRILL BIT FOR HORIZONTAL DIRECTIONAL DRILLING OF ROCK FORMATIONS

CROSS-REFERENCE TO RELATED APPLICATION

This is a continuation-in-part of Provisional Patent Application No. 60/040,747, filed Feb. 5, 1997.

TECHNICAL FIELD

The present invention relates to earth drilling, and more particularly to horizontal directional drilling.

BACKGROUND ART

This invention relates to directional drilling systems. These systems are primarily applicable to horizontal directional drilling, and more specifically to earth and rock formation boring. Low pressure, high volume fluid conduits within the boring bit body are provided for the purpose of lubricating the bit and suspending spoils.

The system of the present invention is designed for lateral or horizontal directional drilling, where it is necessary to bore or drill through an earth-bound formation, such as rock, and still remain directable. This industry, sometimes called "trenchless digging," installs utilities around immovable objects, such as roadways, rivers and/or lakes, etc. The conventional boring technique traditionally operates from a boring device or machine that pushes and/or rotates a drill string consisting of a series of connected drill pipes with a directable drill bit to achieve an underground path or direction through which a conduit or utility device can be installed. A sonde immediately follows the drill bit as it is directed over or under or around obstructions. The sonde transmits electronic positioning signals to a worker on the surface above the sonde by way of a complementary receiving device.

Traditional methods of drilling include a drill body and a drill blade of some type that is usually concentric in design and creates a cylindrical hole about the same diameter as the drill blade. The prior art methods and devices typically use high pressure high velocity jetting to create steerability and cooling of the drill body and blade. My invention uses fluids for the purpose of lubricating and suspending the spoils, as is common in most oilfield-related drilling, and fluids are not used in any way to steer the product by way of jetting.

A severe drawback of all pre-existing horizontal drilling systems is the inability to drill through rock. Prior to my invention, it was accepted in the industry that most rock formations simply could not be drilled, because the rock is too hard. My system, however, has revolutionized thinking along those lines and has been proven to drill through every type of rock formation, even granite. In addition, my system has operational advantages when used to drill less-challenging formations such as soil or sand.

SUMMARY OF THE DISCLOSURE

My directional earth boring system for boring all earth formations such as dirt, sand, rock or any combination of formations, utilizes a bit body containing fixed and semi-floating cutting points and one or more fluid channels for the purpose of lubricating and dispersing cut and/or fractured formations.

In contrast to present drill bit devices or tools, the heel-down method of attachment to the drill body helps to create a random elliptical orbital motion that causes a high impact fracturing action when used in conjunction with the thrust and rotation movement of the associated drill string.

The system is directly related to the size and weight of all the associated drill parts in conjunction with the boring technique utilized. In other words, the exact upper limits of capabilities of this drill bit system are unknown at this time, due to the fact that new techniques or procedures of operation through multiple formations are being developed every day.

A concave channel within the drill bit body is used to reduce the cross-sectional density of the face of the bit during steering as well as providing an alignment guide during boring process.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
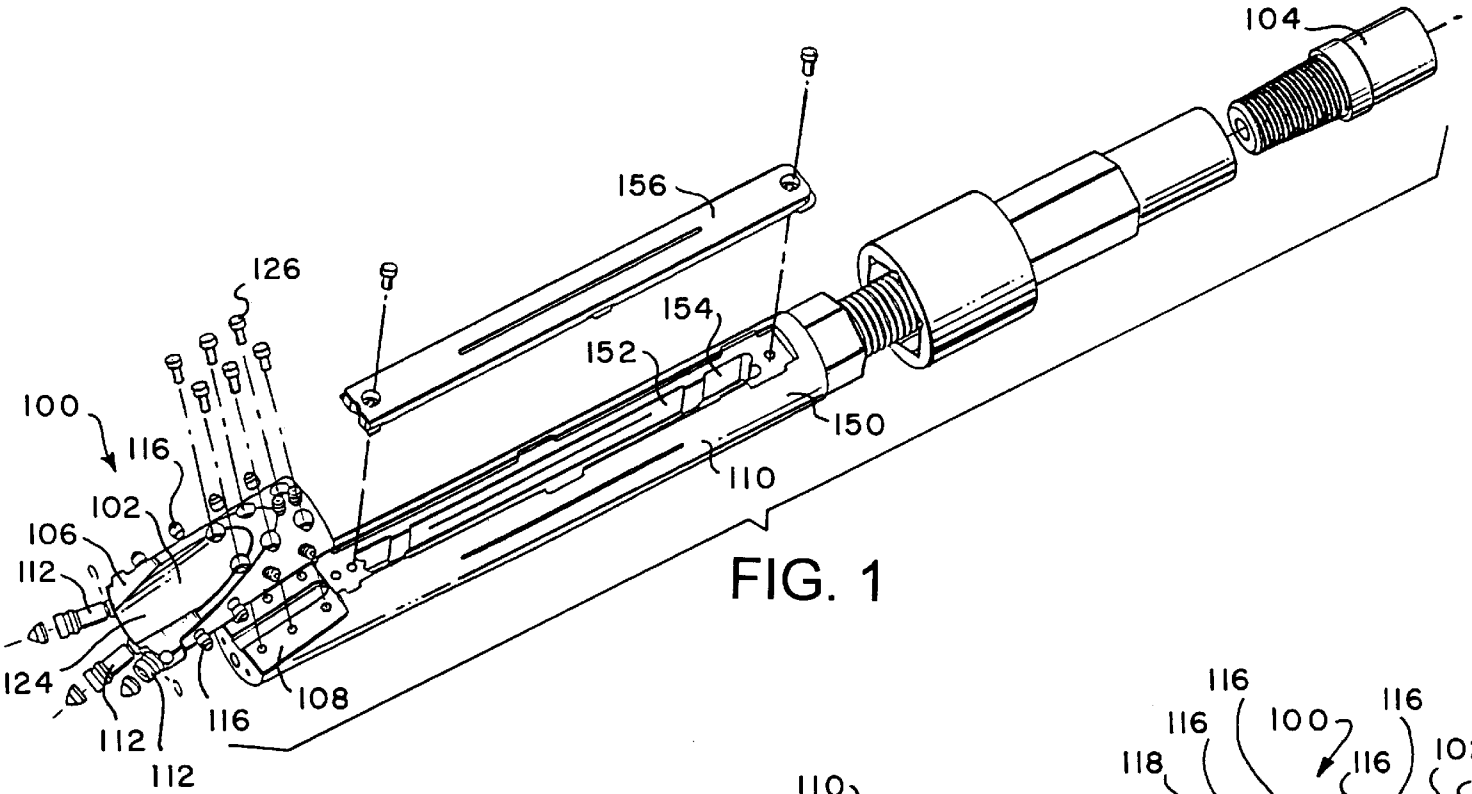
FIG. 1 is an exploded perspective view of the bit and sonde housing of the present invention.

Referring initially to FIGS. 1 through 6, where like numerals indicate like and corresponding, the drilling system including the bit of the present invention is a system of horizontal directional drilling in rock. A drill head 100 includes specially-configured drill bit 102 at one end of a drill string 104 designed to intermittently rotate as it digs in, stops rotation until the rock fractures, and then moves after fracture in a random, orbital intermittent motion. Preferably the drill string 104 is rotated under pressure at a substantially constant rotational velocity at the other end of the drill string 104 by a conventional directional drilling machine. A fluid (not shown) may be pumped into the drill string 104 and out the drill bit 102 to lubricate the hole and disperse cuttings.

In another aspect of the invention, the specially-configured asymmetric drill bit 102 for horizontal directional drilling in rock includes a bit body 106 attached to an end 108 of a sonde housing 110. The bit body 106 is angled with respect to the sonde housing 110, as best shown in FIG. 4, with the angle displacement from collinear alignment being relatively slight, that is, on the order of about 15 degrees.

Figure 4:
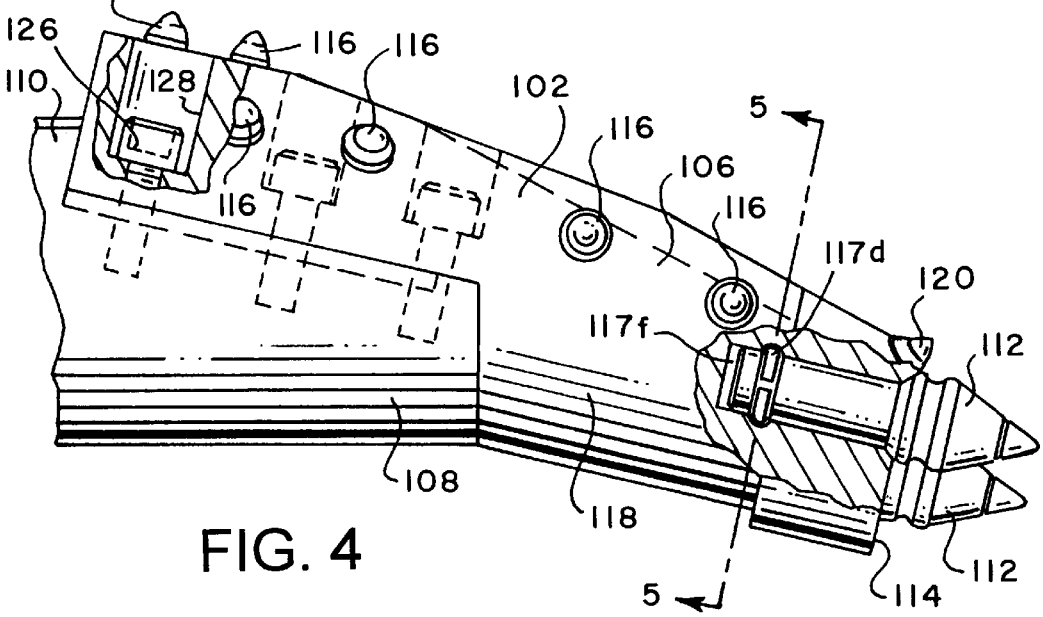
FIG. 4 is a partially broken away side view of the bit and front portion of the sonde housing.
Figure 5:
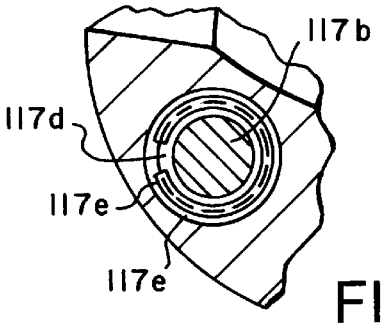
FIG. 5 is a section view taken along lines 5—5 of FIG. 4.
Figure 6:
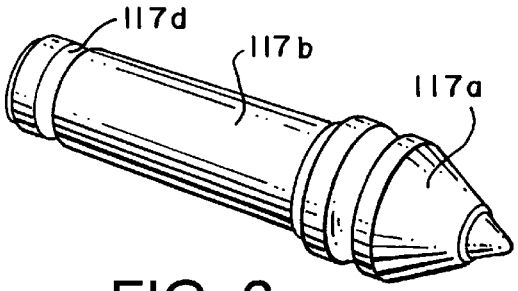
FIG. 6 is a perspective view of an end stud used in the bit.

The bit body 106 is mounted with three substantially forward-facing end studs 112 extending from a planar front face 114 (FIG. 4). A plurality of substantially radially-facing body studs 116 extend from a cylindrical side surface 118.

Figure 2:
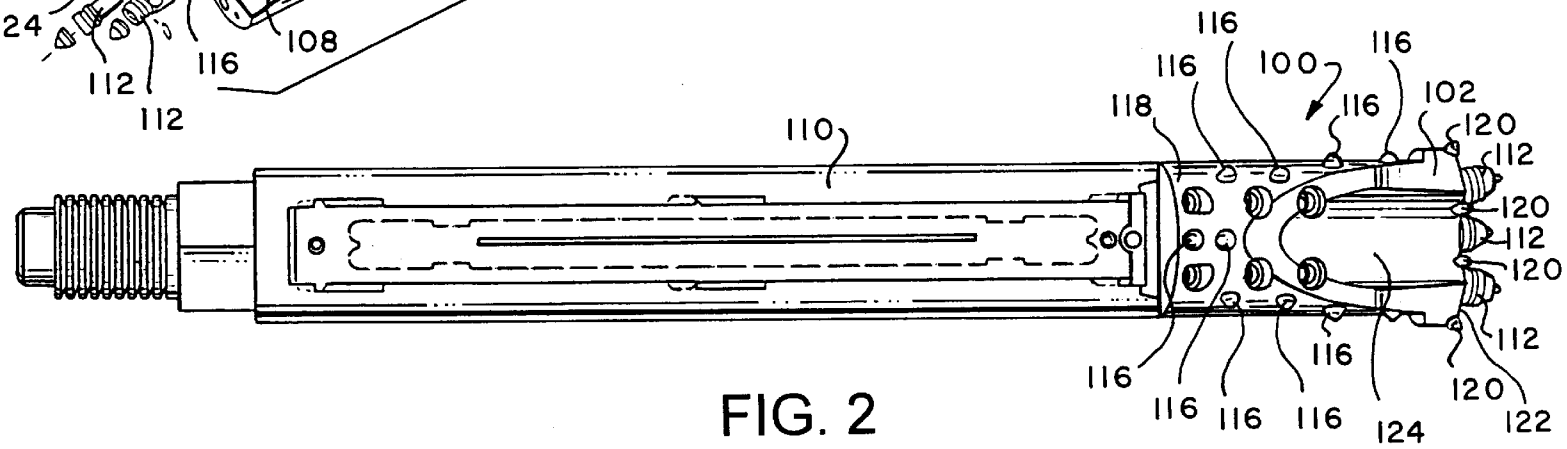
FIG. 2 is a top view of the bit and sonde housing of the present invention.
Figure 3:
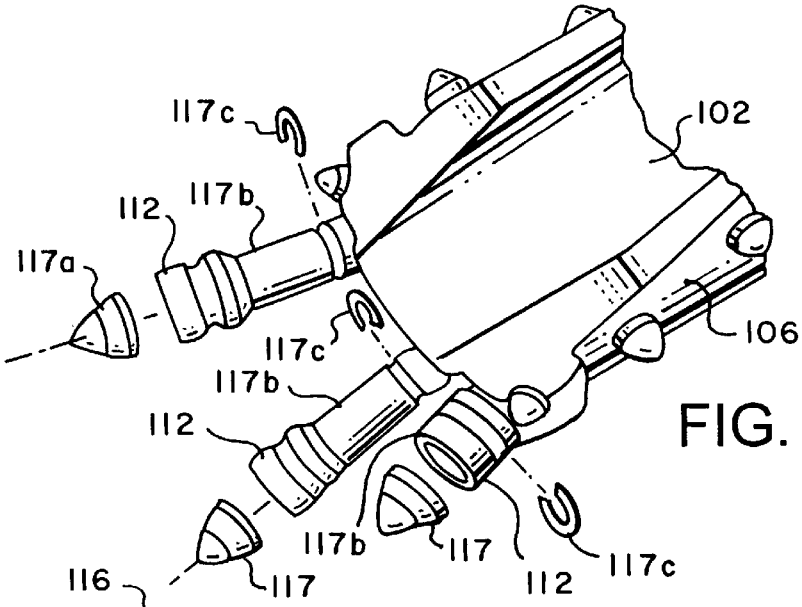
FIG. 3 is an enlarged exploded perspective view of the front portion of the bit.

Each end stud 112 is composed of a carbide tip 117*a,* a stud body 117*b,* and a snap ring 117*c,* as best shown in FIG. 3. Snap rings 117*c* are retained by complementary semi-toroidal grooves 117*d* and 117*e* on stud body 117*b* and cylindrical socket 117*f,* respectively. The three forward-facing end studs 112 are slightly angled with respect to each other, as best shown in FIG. 2, with the longitudinal axis of the middle end stud 112 coplanar with the drill string and the other two angled outwardly, as shown. A plurality of chunk-protection studs 120 extend from an intersection edge 122 (FIG. 2) of the front face 114 and a concave steering face 124. Drill bit 102 has a concave steering channel 125 in substantially laterally-facing steering face 124 of the drill bit. The asymmetric drill bit 102 and sonde housing 110 are joined by threaded fasteners 126.

In operation, the directional earth boring tool system for boring all earth formations such as dirt, sand, rock and/or any type combination of formations, utilizes the bit body containing fixed and semi-floating cutting points and one or more fluid channels for the purpose of lubricating and dispersing cut and/or fractured formations. The high-impact point-fracturing method of removal of dense or rocky formations also creates a high-velocity orbital node while drilling softer or less dense formations. The key feature of the invention is that bit 102 stops and starts as it digs in and then fractures rock, then jumps to a new position.

The beveled cavity within the bit design allows the bit to be steerable in all formations. The bit body is attached to the boring drill body, which contains at least one or more fluid channels, by means of an interference connection that withstands transverse loading. The asymmetrical method of attachment incorporates resultant reactions from the drill stem and drill body derived from input torque and thrust supplied by drilling machine, to create a random elliptical pattern while boring which also creates a hole larger than the concentric design of the drill body would typically allow.

Drilling of hard rock formations is defined as a fracturing process as opposed to a cutting or shearing operations as used in conventional earth drilling applications. It is known that earth boring for horizontal directional drilling may be a combination of cutting or shearing and jetting. The jetting methods employ a system of high pressure, high velocity fluids with the specific purpose of making a suspension, or solution of earth formations and flowing these suspensions or solutions into the surrounding formations or out of the bore hole. Cutting or shearing systems use fluids to lubricate the drilling tools as well as carry off the spoils of drilling. Rock formations do not cut or shear well, and do not dissolve or contain binding components that are easily disassociated with water solvents or hydraulic forces of jetting.

No current drilling bit and process combines the operational parameters of rock fracturing, and high included angle offsets for directional steering in soft earth formations.

The new asymmetrical directional drilling point for rock and hard earth formations combines the techniques of point contact fracturing for rock with a high angle of attack for hard earth as well as soft formations. Fracturing is accomplished with application of hard carbide points on random elliptical torque vectors created as the asymmetrical geometry of the bit forms eccentric rotational paths by combination of rotation and thrust moments. Drilling of rock like shales that are typically considered to be compressed and extremely dense and dry clays are also enhanced by the aggressively pointed geometry of the drill bit.

The asymmetrical geometry enhances the performance of the drill rack by multiplying the fracturing effect through leverage on the main drilling points. As the drill bit rotates the offset drill points randomly fracture and engage as center points of rotation and multiply transverse moments 3 to 8 times the actual transverse moments that can be produced at the same diameter in a symmetrically formed fixed diameter drill bit.

Bore hole size is defined and controlled by stabilizing the forward cutting points on a trailing shoe that contains replaceable, semipermanent carbide buttons that will fracture off irregular surfaces and help smooth the borehole as well as reduce the abrasive wear on the body of the bit.

Rock or hard earth steering is accomplished by a partial rotation boring method. This method is applied by thrusting the bit into the bore face at a predefined rotational index position and rotating to a similarly defined end rotation position and then pullback. The procedure is then repeated as often as necessary to form the borehole into the desired amount of turn.

Many test bores have already been successfully completed where the "partial rotation bore" process has successfully navigated through hard shales, sandstone, light limestone, Austin chalk, and concrete with and without steel reinforcing.

Steering in soft surface formations is easy using the standard non-rotating push-steer techniques as would be used with a flat paddle bit. The semi-elliptical channel cut into the steering shoe guides the bit to help it maintain a path parallel to the plane of the arc created by steering the bit. This reduces cross drift when push steering.

The "steering channel" also reduces the frontal blank surface area greater than 50% resulting in less chances of "formation buildup." This enhances push steering performance as well as eases the ability of drilling spoils to flow under the bit when straight boring.

This drill bit does not use jetting or directed fluid application to enhance the performance of the drilling action. Drilling fluid is required to clean the drill bit and remove spoils from the bore hole. The drill bit will not generate high pressure during normal drilling applications.

A unique shear relief structure is provided to reduce the loads on fasteners used to attach the rock bit to the sonde housing. The shear relief includes a longitudinal recessed groove, having a rectangular cross-section, and a matching raised tongue on the back side of the rock bit. The tongue extends substantially the entire length of the rock bit back side, for substantially complete engagement of the groove. In operation, the shear relief removes substantially all the shear load on the fasteners used to hold the rock bit to the sonde housing. The fasteners provide clamping pressure only, while the shear relief absorbs the enormous shear forces applied to the rock bit.

Whereas, the present invention has been described with respect to a specific embodiment thereof, it will be understood that various changes and modifications will be suggested to one skilled in the art, and it is intended to encompass such changes and modifications as fall within the scope of the appended claims.

I claim:

1. An asymmetric drill bit for horizontal directional drilling in rock, comprising:

a bit body attached to an end of a sonde housing;

the unitary bit body being angled with respect to the sonde housing the bit body being nonmovable with respect to the sonde housing in drilling operation; and the bit body being mounted with a plurality of substantially forward-facing end studs extending from a front face of the bit body.

2. The bit of claim 1 with a plurality of substantially radially-facing body studs extending from a side surface.

3. The bit of claim 1 with three forward-facing end studs.

4. The bit of claim 2 with the three forward-facing end studs being slightly angled with respect to each other.

5. The bit of claim 3 with a plurality of chunk-protection studs extending from an intersection edge of the front face and a steering face.

6. The bit of claim 5 with a concave steering face.

7. An asymmetric drill bit for horizontal directional drilling in rock, comprising:

a bit body attached to an end of a sonde housing;

the unitary bit body being angled with respect to the sonde housing the bit body being nonmovable with respect to the sonde housing in drilling operation;

the bit body being mounted with three substantially forward-facing end studs extending from a front face of the bit body;

with a plurality of substantially radially-facing body studs extending from a side surface;

with the three forward-facing end studs being slightly angled with respect to each other; and with a plurality of chunk-protection studs extending from an intersection edge of the front face and a concave steering face.

* * * * *

UNITED STATES PATENT AND TRADEMARK OFFICE

CERTIFICATE OF CORRECTION

PATENT NO : 5,899,283
DATED : 05/04/99
INVENTOR(S) : David M. Cox

It is certified that error appears in the above-identified patent and that said Letters Patent are hereby corrected as shown below:

Col. 4, line 55, insert --unitary-- before "bit".
Col. 4, line 56, delete "unitary".

Col. 5, line 9, insert --unitary-- before "bit".
Col. 5, line 10, delete "unitary".

Signed and Sealed this

Tenth Day of April, 2001

*Attest:*

Nicholas P. Godici

NICHOLAS P. GODICI

*Attesting Officer*

*Acting Director of the United States Patent and Trademark Office*